US010737749B2

(12) United States Patent
Easterling

(10) Patent No.: US 10,737,749 B2
(45) **Date of Patent: *Aug. 11, 2020**

(54) AUTONOMOUS UNDERWATER VEHICLE FOR AIDING A SCUBA DIVER

(71) Applicant: Jacob Easterling, Malabar, FL (US)

(72) Inventor: Jacob Easterling, Malabar, FL (US)

(73) Assignee: SCUBOTICS, LLC, Malabar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/294,473

(22) Filed: Mar. 6, 2019

(65) Prior Publication Data

US 2019/0202537 A1 Jul. 4, 2019

Related U.S. Application Data

(63) Continuation of application No. 15/449,597, filed on Mar. 3, 2017, now Pat. No. 10,227,117.

(60) Provisional application No. 62/302,867, filed on Mar. 3, 2016.

(51) Int. Cl.

| | |
|---|---|
| ***B63G 8/00*** | (2006.01) |
| ***B63C 11/26*** | (2006.01) |
| *B63C 11/02* | (2006.01) |

(52) U.S. Cl.

CPC ..... *B63G 8/001* (2013.01); *B63C 11/26* (2013.01); *B63C 2011/021* (2013.01); *B63G 2008/004* (2013.01)

(58) Field of Classification Search

CPC ... B63G 8/001; B63G 2008/004; B63C 11/26; B63C 2011/021

USPC ..... 701/21

See application file for complete search history.

(56) References Cited

U.S. PATENT DOCUMENTS

| | | | |
|---|---|---|---|
| 3,584,595 | A | 6/1971 | Perry |
| 3,810,080 | A | 5/1974 | Hunter |
| 5,331,602 | A | 7/1994 | McLaren |
| 5,666,326 | A | 9/1997 | Holzschuh |

(Continued)

FOREIGN PATENT DOCUMENTS

WO 2016068715 A1 5/2016

OTHER PUBLICATIONS

Webber, Dale Dr. "Vemco Acoustic Telemetry New User Guide." Copyright 2009 by Amirix Systems, Inc. http://vemco.com/wp-content/uploads/2012/11/acoustic.telemetry.pdf.

(Continued)

*Primary Examiner* — Gertrude Arthur Jeanglaude

(74) *Attorney, Agent, or Firm* — Beusse, Wolter, Sanks & Maire PLLC; John L. DeAngelis

(57) ABSTRACT

A system for use by a diver during an underwater dive. An autonomous underwater vehicle (one component of the system, AUV) comprises a component for detecting that the AUV has entered water, an AUV acoustic transceiver, a plurality of AUV sensors, a propulsion unit, a processor for determining dive information and diver information responsive to data from one or both of the AUV acoustic transceiver and the plurality of AUV sensors, and one or more cameras. Diver equipment carried by the diver comprises a plurality of diver sensors and a diver acoustic transceiver for receiving sensed information from the plurality of diver sensors and communicating the sensed information to the AUV, and for receiving information from the AUV acoustic transceiver.

20 Claims, 16 Drawing Sheets

(56) References Cited

U.S. PATENT DOCUMENTS

| | | | | |
|---|---|---|---|---|
| 6,854,410 | B1 | 2/2005 | King | |
| 6,941,126 | B1 | 9/2005 | Jordan, Jr. | |
| 6,972,715 | B2 | 12/2005 | Hollis | |
| 7,272,074 | B2 | 9/2007 | Basilico | |
| 7,483,337 | B2 | 1/2009 | Basilico | |
| 7,969,822 | B2 | 7/2011 | Basilico | |
| 8,018,794 | B2 | 9/2011 | Thierry | |
| 8,174,436 | B2 | 5/2012 | Hollis | |
| 8,536,983 | B2 | 9/2013 | Harasti | |
| 8,804,461 | B2 | 8/2014 | Imran | |
| 9,013,349 | B2 | 4/2015 | Hollis | |
| 9,118,407 | B2 | 8/2015 | Imran | |
| 9,443,039 | B2 | 9/2016 | Hollis | |
| 10,227,117 | B2 * | 3/2019 | Easterling | B63C 11/26 |
| 2011/0055746 | A1 | 3/2011 | Mantovani | |
| 2012/0022820 | A1 | 1/2012 | Schmitz | |
| 2015/0175248 | A1 | 6/2015 | Hollis | |
| 2016/0009347 | A1 | 1/2016 | Imran | |
| 2016/0041269 | A1 | 2/2016 | Lewis | |

OTHER PUBLICATIONS http://ibubble.camera/autonomous-underwater-camera/technical-specifications/.
http://www.issia.cnr.it/wp/?portfolio=caddy-cognitive-autonomous-diving-buddy.

* cited by examiner

AUTONOMOUS UNDERWATER VEHICLE FOR AIDING A SCUBA DIVER

CROSS REFERENCE TO RELATED APPLICATIONS

This patent application claims the benefit, as a continuation application, of U.S. nonprovisional application filed on Mar. 3, 2017, assigned application Ser. No. 15/449,597, and entitled Autonomous Underwater Vehicle for Aiding a Scuba Diver, now U.S. Pat. No. 10,227,117, which claims priority to the provisional patent application filed on Mar. 3, 2016, assigned Application No. 63/302,867, and entitled Autonomous Underwater Vehicle for Aiding a Scuba Diver. Both of these applications are incorporated herein in their entirety.

BACKGROUND OF THE INVENTION

In an ideal situation, a SCUBA (self-contained underwater breathing apparatus) dive is an enriching experience of weightlessness and freedom while taking in the bounty of the ocean. Divers however spend much of their time juggling between tasks such as: checking gauges, holding cameras, and fumbling with flashlights. While some of these tasks are mere inconveniences, others, if neglected, are life threatening. This invention helps alleviate the cumbersome burden of managing these tasks, thereby enriching the diving experience.

BRIEF DESCRIPTION OF THE FIGURES

The skilled artisan will understand that the drawings, as described below, are for illustration purposes only. The drawings are not intended to limit the scope of the present invention in any way. Several of the figures are block diagrams that depict the components necessary for the operation of the invention.

DETAILED DESCRIPTION OF THE INVENTION

Figure 1B:
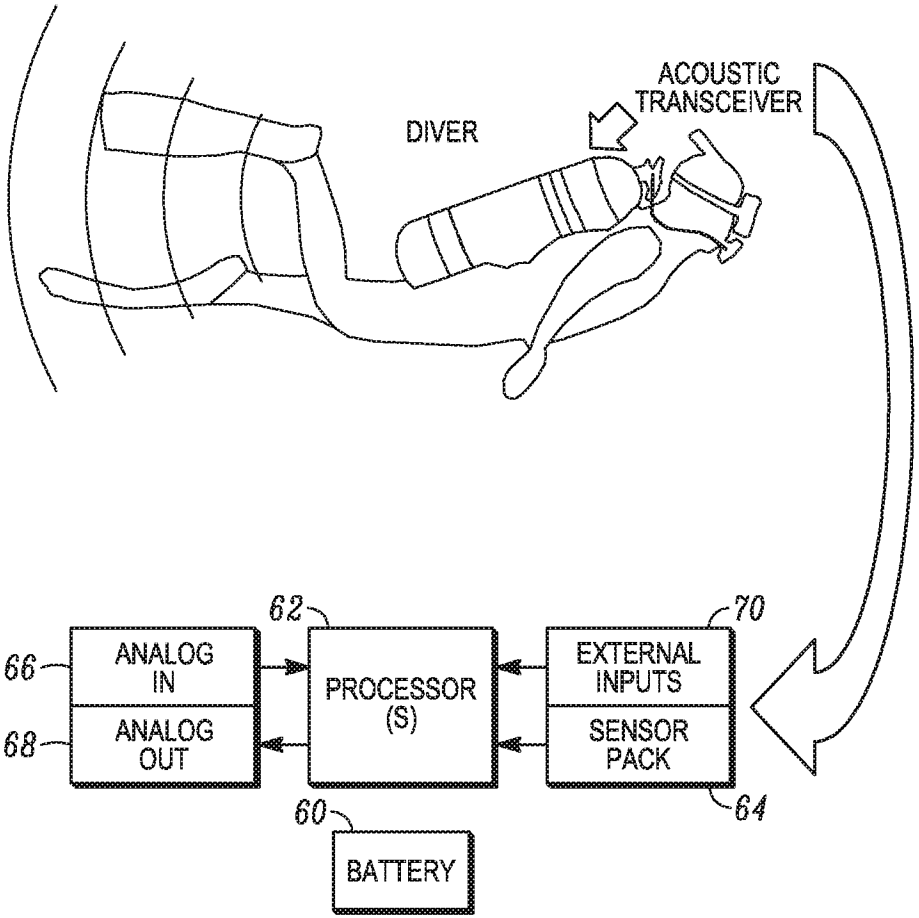
FIGS. 1A and 1B are pictorial illustrations and block diagrams of one embodiment of a system of the present invention.

Before describing in detail the particular methods and apparatuses related to an autonomous underwater vehicle for aiding a diver, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the inventions. The presented embodiments are not intended to define limits as to the structures, elements or methods of the inventions, but only to provide exemplary constructions. The embodiments are permissive rather than mandatory and illustrative rather than exhaustive.

An apparatus and system for autonomously aiding a diver by performing a multiplicity of tasks related to and during the dive. The system of the invention is comprised of two principal components: an Autonomous Underwater Vehicle (AUV) that accompanies, tracks, and photographs (i.e., collects video images) the diver during the dive, and a sensor payload attached to the diver.

Before the dive begins, the user (who may or not be the diver) pairs the AUV transceiver/transmitter with the diver's transceiver/transmitter. The pairing process occurs by bringing the diver's transceiver/transmitter proximate the AUV while the 'pair mode' has been selected. The AUV then assigns a unique identification signature to the diver's transceiver/transmitter (to be included in any transmission from the diver and/or to the diver). The unique identification signature may comprise a sequence of pulses that serve as a header for incoming/outgoing messages.

At the beginning of a dive, the diver activates the AUV and throw it into the water as or before he enters the water. Upon sensing water between two external electrodes, the AUV wakes up and scans for an acoustic signal transmitted from the diver. Once the unique acoustic identification signature has been detected, and thus the diver's transmitter identified, the AUV follows the diver, records/photographs various aspects of the dive, monitors the diver's condition and the condition of his dive equipment, illuminates a proximate region of the sea, and issues alerts if the diver faces a life-threatening situation.

One embodiment of the invention comprises two principal components, an AUV (FIG. 1A) and a sensor payload (FIG. 1B) on the diver. The AUV is self-propelled, intelligent (capable of making decisions and calculating values based on input sensor data), aware of its surroundings, and communicates with devices carried by the diver, e.g., within the diver's sensor payload.

The diver carries an acoustic transceiver that enables two-way communication with the AUV. Upon request from the AUV, the diver's transceiver reports sensor information to the AUV, such as dive depth (which can be determined according to several techniques known to those skilled in the art), water temperature, velocity of the diver, and acceleration of the diver.

Figure 10:
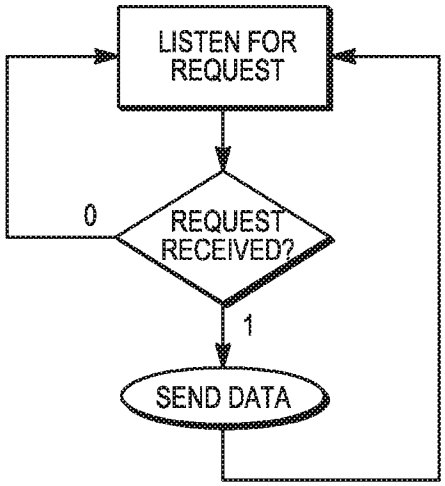
FIG. 10 is a flowchart description of the data relay from the diver to the AUV.

See a flow chart of FIG. 10. The diver's transceiver continuously listens for signals from the AUV. Upon receiving a signal containing a request, the diver's transceiver replies with the requested data as derived from one or more sensors carried by the diver, e.g., within the diver's sensor payload. The AUV uses the received information to, for example, determine the diver's location (as described further below) as well as to calculate the diver's bottom time, which is necessary for formulating a decompression time schedule needed upon ascension from the bottom to prevent decompression sickness.

In one embodiment both the AUV and the diver's transceiver (an acoustic transceiver in one embodiment) are both equipped with multiple sensors, reducing the processing complexity and processing duration of the AUV's location determination systems (LDS). That is, if the diver wore only an acoustic pinger, which transmitted a pinging signal but provides no information (such as the diver's current depth), then it would be necessary for the AUV to process more sophisticated algorithms to determine the location and/or depth of the diver. The more position information the diver can supply to the AUV reduces the complexity of the location algorithms processed at the AUV. This process is described in further detail hereinbelow.

The diver's transceiver can be equipped to report many different types of information, such as oxygen tank levels, and the diver's heart rate.

The AUV is equipped with emergency protocols that can either be executed manually by the diver via his/her wearable transceiver or automatically if the AUV identifies an anomaly in the sensor data. For example, if the diver's heart rate drops below a predetermined threshold, or a two-way communication channel between the AUV and the diver in interrupted).

Under normal conditions, (i.e., emergency protocols have not been executed) the AUV follows the diver, assisting with tasks such as recording elements of the dive and providing illumination for the diver.

Upon the end of the dive, the AUV can use the diver's depth information to track the diver's ascension and provide a visual reference for safety stops (as further described herein).

The AUV is equipped with, but not limited to, one camera(s). The camera or each camera in another embodiment, is equipped with wide angle hemispheric lenses that allow the AUV to keep the diver within the field of view independent of the AUV's orientation relative to the diver. Common image processing techniques are used to stitch the images together to enable the diver to relive his dive experience. In one embodiment, a virtual reality technique is used to enhance the experience.

Autonomous Underwater Vehicle

Figure 1A:
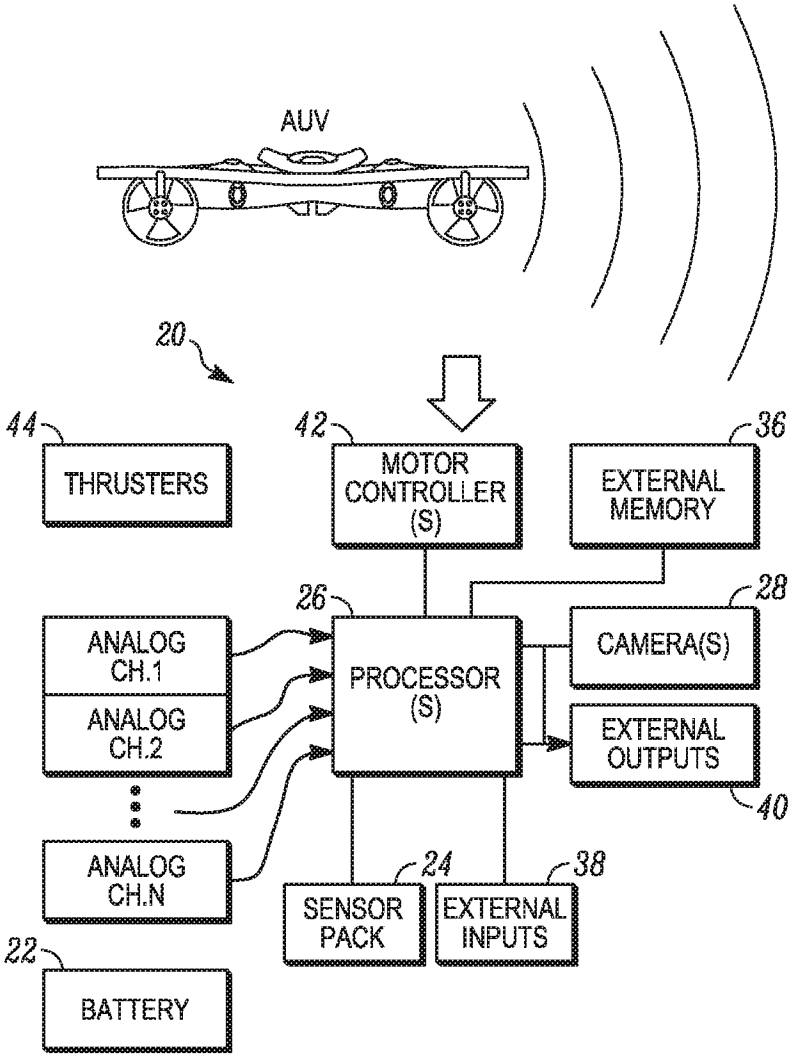

FIG. 1A is a block diagram of components of the AUV 20. A battery 22 provides power for electronics components of the AUV 20. A sensor pack 24 comprises a plurality of sensors (e.g., a gyro, accelerometer) each supplying information related to a sensed parameter for use by a processor 26 for executing the various AUV functions as described herein. Camera(s) 28, as controlled by the processor 26, provide video data within their field of view for use by the processor 26 as described herein.

Analog channels 1-*n* convert acoustic signals from respective acoustic sensors 1-*n* into digital signals for processing by the processor 26. These acoustic sensors detect sound waves passing through the water, including acoustic signals transmitted from the diver. As described elsewhere herein, the acoustic channels each capture the same acoustic signal but at different times. The signal and time information is analyzed within the processor to gain valuable information regarding the position of the diver (or any device emitting acoustic signals).

An external memory 36 provides mass storage for the high-quality video images as supplied by the camera(s) 28 as well as other pertinent data.

External inputs 38 represent digital (or analog) inputs that input digital data and implement certain operational modes as controlled by the input data, such as ON/OFF, or selection of a communication channel. The availability of multiple communications channels allows the use of multiple AUVs in the same area without communication interference. In an application including multiple AUV's and/or multiple divers, each diver and AUV is typically assigned a unique identifier or code that is appended to each transmitted communications signal.

External outputs 40 (including one or both of analog and digital outputs) provide analog and digital signals for controlling devices that interact with the AUV. A motor controller(s) output 42 provides control signals to drive thrusters 44 to move and position the AUV 20. The thrusters are positioned on the AUV to allow the AUV to move in all directions, e.g., up, down, left, right.

FIG. 1B depicts the components carried by the diver, including a battery 60, a processor 62, a sensor pack 64 (also referred to as a plurality of sensors). The processor 62 can receive analog inputs 66 and provide analog (or digital) outputs 68. External digital inputs 70 are also supplied to the processor 62. Analog inputs include acoustic sound waves that can be used for ascertaining "world frame" information (i.e. where is the AUV with respect to the diver). Digital inputs include binary user input controls such as: on/off, tracking distance, etc.

Generally, the components of FIG. 1B have similar functionality to identically-named components of FIG. 1A.

The AUV moves through the water using a propulsion system comprised of at least but not limited to a single thruster (or as many as four thrusters in one embodiment). Other embodiments include various combinations of rudders/steerable thrusters (active adjustable flaps or propellers that control the direction of the AUV) and/or air bladders (on-board air chambers that can be expanded/compressed to maintain the stability and heading of the AUV. These additional components representing other embodiments of the invention potentially reduce the number of AUV thrusters at the cost of additional control complexity.

AUV Intellligence and Control

The AUV has at least one, but not limited to one, control logic block, also sometimes referred to as the processor 26 of FIG. 1A. In certain embodiments, the processor may be implemented by a microcontroller, a digital signal processor, an FPGA (field programmable gate array), etc. for performing the AUV control functions.

One embodiment comprises a single processor to operate the AUV control functions, SONAR, and camera(s), as well as other functions associated with the AUV.

One function of the processor/controller(s) is to ensure that the AUV remains stable in the water and reliably follows the diver.

Figure 2:
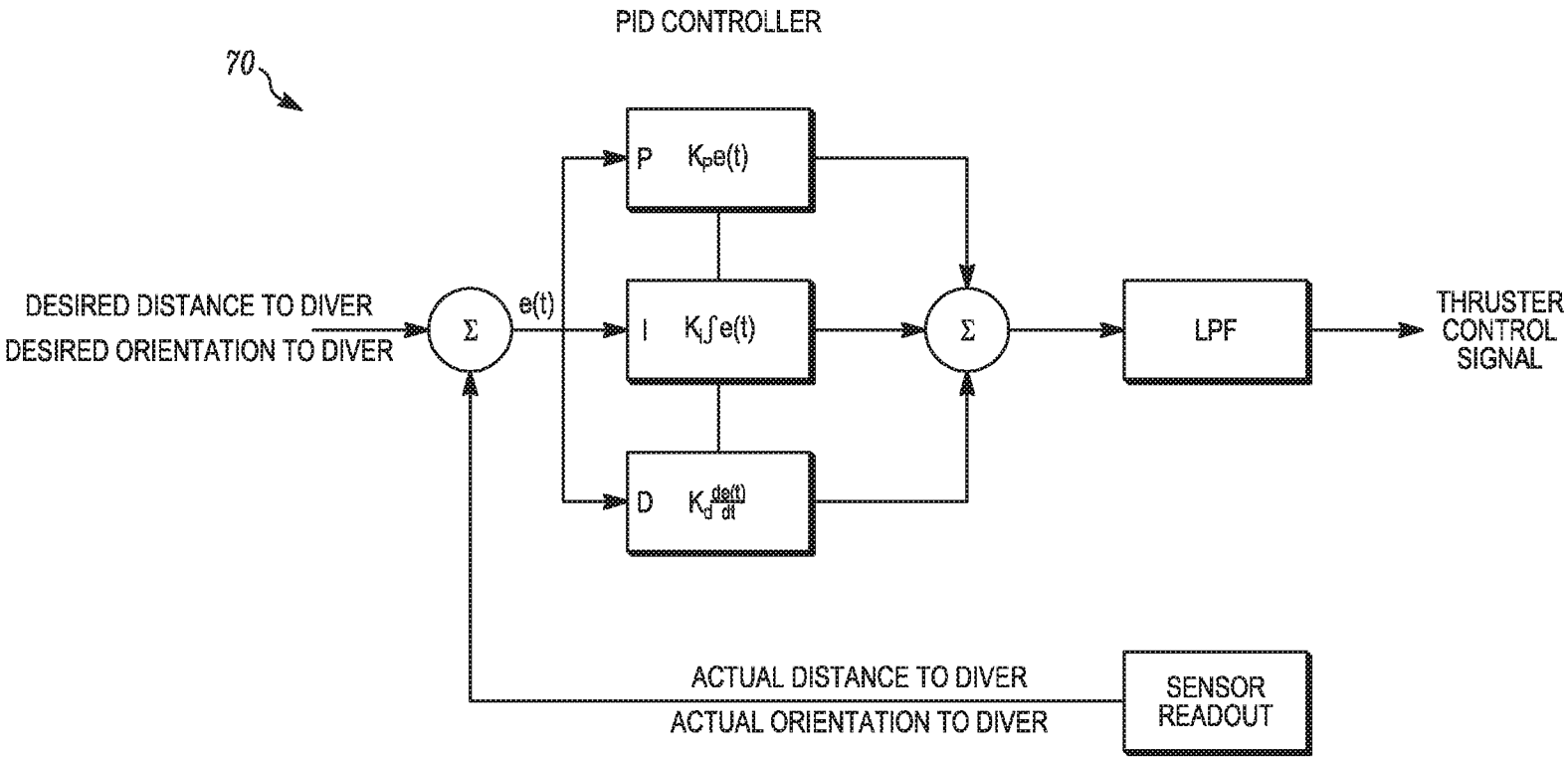
FIG. 2 is a block diagram of an embodiment of a PID control system.
Figure 3:
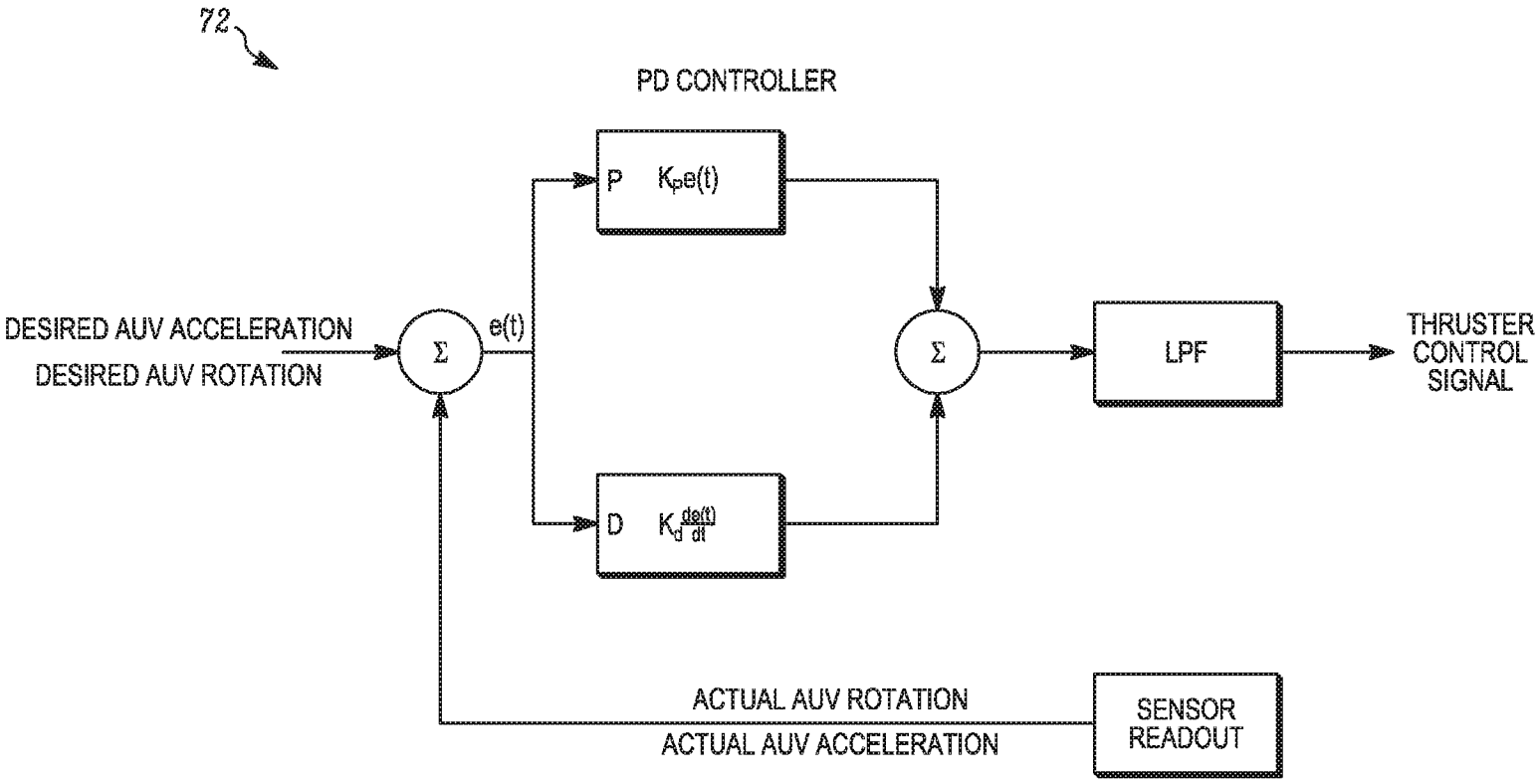
FIG. 3 is a block diagram of an embodiment of a PD control system.
Figure 4:
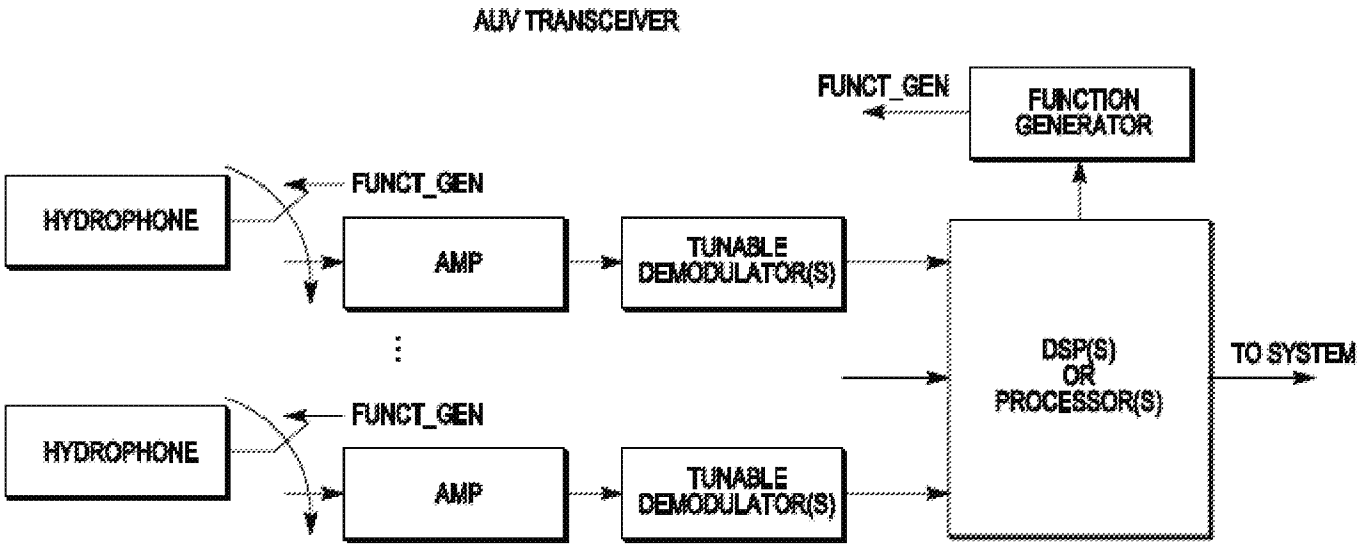
FIG. 4 is a block diagram of an acoustic transceiver located on the AUV.

FIGS. 2, 3, and 4 are block diagrams of exemplary AUV controllers that can be implemented by the processor 26 (see FIG. 1A) or can represent stand-alone subsystems of the AUV 20.

The block diagram of a controller 70 of FIG. 2, the functionality of which can be implemented in some embodiments in the processor of FIG. 1A, calculates a thruster control signal based on distance and bearing to the diver. The AUV is programmed to maintain a specific distance away from the diver. If the distance to the diver does not equal that specific distance, the thrusters engage to move the AUV to the desired position relative to the location of the diver. The thruster control signal is input to the AUV thruster(s) 44 of FIG. 1A to maintain a consistent distance, angle and declination with respect to the diver, where the angle refers to an orientation relative to a horizontal axis and declination refers to an orientation relative to a vertical axis.

The controller 70 of FIG. 2 comprises PID (proportional, integral, and differential) control loops and is therefore referred to as a PID controller. As can be seen, each loop in the controller 70 operates by taking a proportional (fractional) share, integrating, or differentiating an error signal e(t). The proportional control loop reacts quickly to any error. The integral control loop reacts to a continuous error and the differential control loop reacts to sudden changes in the error. The block labeled "LPF" represents a low-pass nature of the AUV (low-pass meaning that the system is stable and does not naturally oscillate exponentially).

A preferred PID controller is an effective closed-loop control system because it accounts for the proportional, integral, and derivative of an input error signal. The summation of these three paths results in a decrease in error as well as improvements in rise/settling time and overshoot. The PID controller can accurately track complex systems that might be difficult or impossible for simpler controllers (such as a proportional-derivative (PD), or a proportional (P) controller) to effectively control. Simple controls, such as roll, pitch, and yaw stability of the AUV, can also be handled by a PID controller.

The PD controller 72 (see FIG. 3), like the PID controller of FIG. 2, also controls the roll, pitch, and yaw of the AUV by again providing a thruster control signal responsive to an error between a gyro input signal representing a desired roll, pitch, and yaw to keep the AUV platform balanced and level while underwater.

However, control (e.g., the thruster control signal) provided by the PD controller is not as accurate and timely as control provided by the PID controller. Generally, it is not necessary for an AUV according to the present invention to include both a PID and a PD controller. In other embodiments, the controllers 70 or 72 may comprise other controller types, e.g., P, I, D, PI, PD, or ID controllers.

Each controller 70 and 72 continuously calculates an error value e(t) as a difference between a measured process variable and a desired set point for that variable.

Unlike the PID controller of FIG. 2, the PD controller of FIG. 3 lacks the integral component when calculating the control signal to drive the thrusters. A PD controller may not be able to effectively track and follow moving target, such as a diver. The integral calculation in the PID controller is a key differentiator. If the diver and the AUV are moving together and suddenly the diver accelerates, the Integral component will begin to increase, which will force the AUV to increase its speed as well to follow the diver. During diver deceleration, a similar effect will occur.

The AUV is equipped with an on-board sensor pack 24 of FIG. 1A that may include, for example, gyroscopes, accelerometers, magnetometers, pressure sensors, etc. The output of these sensors may be input to several controllers such as the PID controller 70 of FIG. 2 or the PD controller 72 of FIG. 3.

To maintain a predetermined distance from the diver, the AUV runs the distance-to-diver data through the PID controller 70, which allows the AUV to determine if it needs to change the speed of its thrusters to maintain that predetermined distance.

For simplicity sake, this discussion assumes the input data to the controller 70 or 72 is linear. A control system can be developed for accommodating non-linear inputs, such as inputs relating to drag/drift of the AUV. If non-linear inputs are considered, a state space model (a mathematical model of a physical system as a set of input, output and state variables) of the AUV would be constructed and incorporated into the system of the invention.

One element of the sensor pack 24 comprises a SONAR device that both sends acoustic signals to and receives acoustic signals (echoes) from an object, such as a diver. These signals are used to calculate distance, angle, and azimuth to the diver and/or to obstacles proximate the diver or within the diver's path. Those inputs represent the "Distance to Diver, Angle, and Declination to the Target" inputs to a summer 78 of the PID controller 70 of FIG. 2.

An array of acoustic sensors (with the sensors having a known and predetermined spacing) captures incoming signals from the diver's transceiver which are then used to calculate the location of the diver in water. This location is preferably in terms of distance to the diver, angle to the diver and the declination to the diver.

Figure 6:
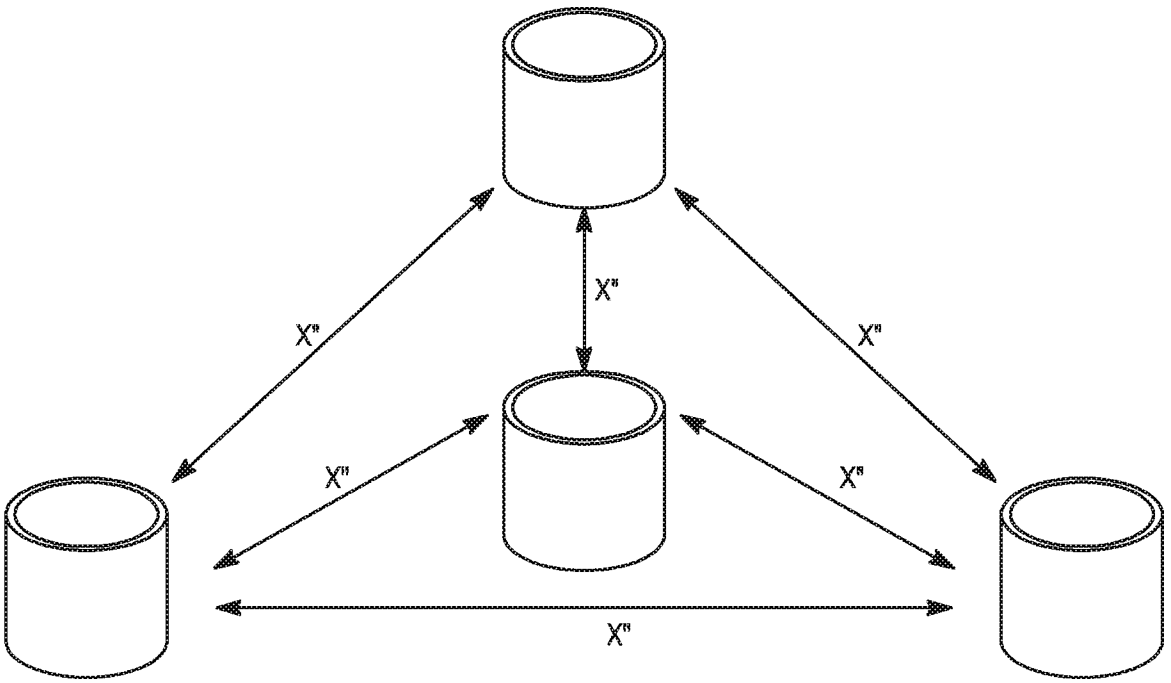
FIG. 6 is a pictorial description of the sensor array used to transmit and receive information between the AUV and the diver. These sensors are attached to the AUV and spaced a distance X apart from each other as illustrated.

An embodiment of the array can be seen in FIG. 6. The sensors depicted in FIG. 6 may comprise any piezoelectric material (such as ceramic sensor in one embodiment) resistant to the effects of water at depths at which the AUV is intended to operate. These sensors act as a phased array antenna, i.e., each individual sensor operates independently of the others and the sensors are physically arranged to accommodate calculation of the diver's location, i.e., distance, angle and declination. Each element in the phased array antenna detects a passing sound wave at different times. These time differences and the known distances between the sensors, are used to determine the diver's location.

In one embodiment, the system uses a trilateration algorithm to determine the coordinates of the diver. Trilateration uses the measurement of the time of arrival (TOA) of the response from two or more sensors at known locations (on the AUV) to a broadcast signal sent at a known time from the AUV and reflected from the diver, to determine the diver's location. The formula for TOA is $TOA={}^{t}f/2-t_0$ where $t_0$ is the transmit time of the outgoing signal from the AUV, and $t_f$ is the receiving time of the echo as received at each sensor of the AUV. The value for $t_f$ is divided by two to account for the round-trip time required for the transmit signal to travel from the AUV to the diver and the response signal from the diver back to the AUV.

Figure 11:
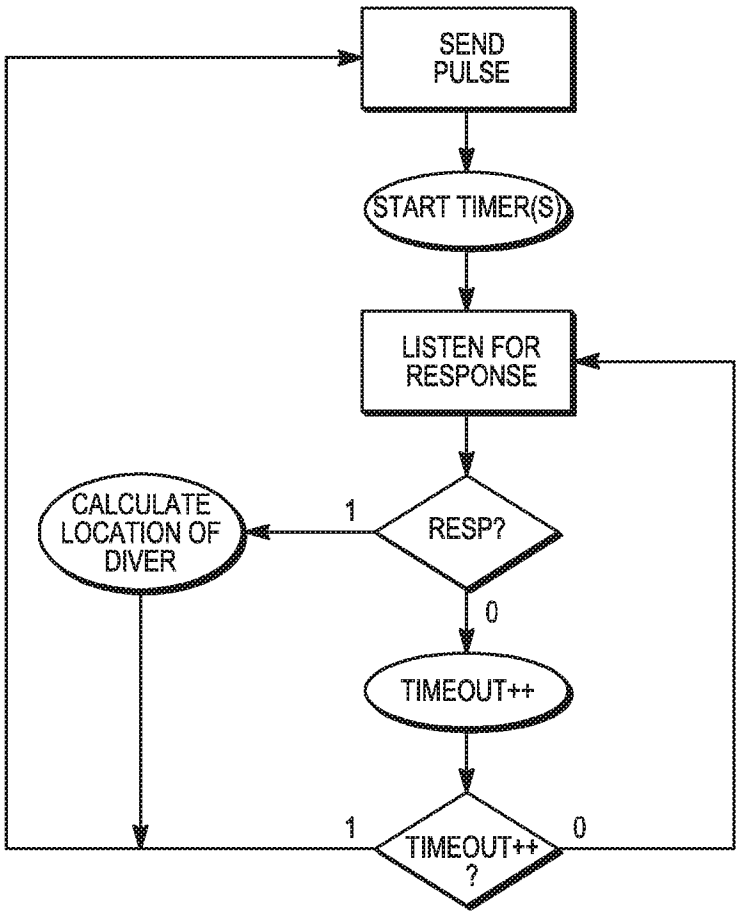
FIG. 11 is a flowchart description of the process to determine the location of the diver with respect to the AUV.

The FIG. 11 flowchart illustrates the trilateration process. When a pulse is transmitted from the AUV, a timer starts and the system listens for a response. If a response is received (an echo), the diver's location can be calculated. If a response is not received the timer continues to run while listening for a response or the timer times-out.

By multiplying the TOA by the speed of sound underwater (1484 m/s) a circle of radius "r" can be generated where r=TOA*speed_of_sound. Each sensor in the array performs a TOA measurement and each generates a circle where all possible diver locations are located along the circumference of that circle. Multiple sensors generate multiple circles with the intersection of the circles representing the highest probable location for the diver. The accuracy of this process increases as the number of sensors increases.

Figure 7:
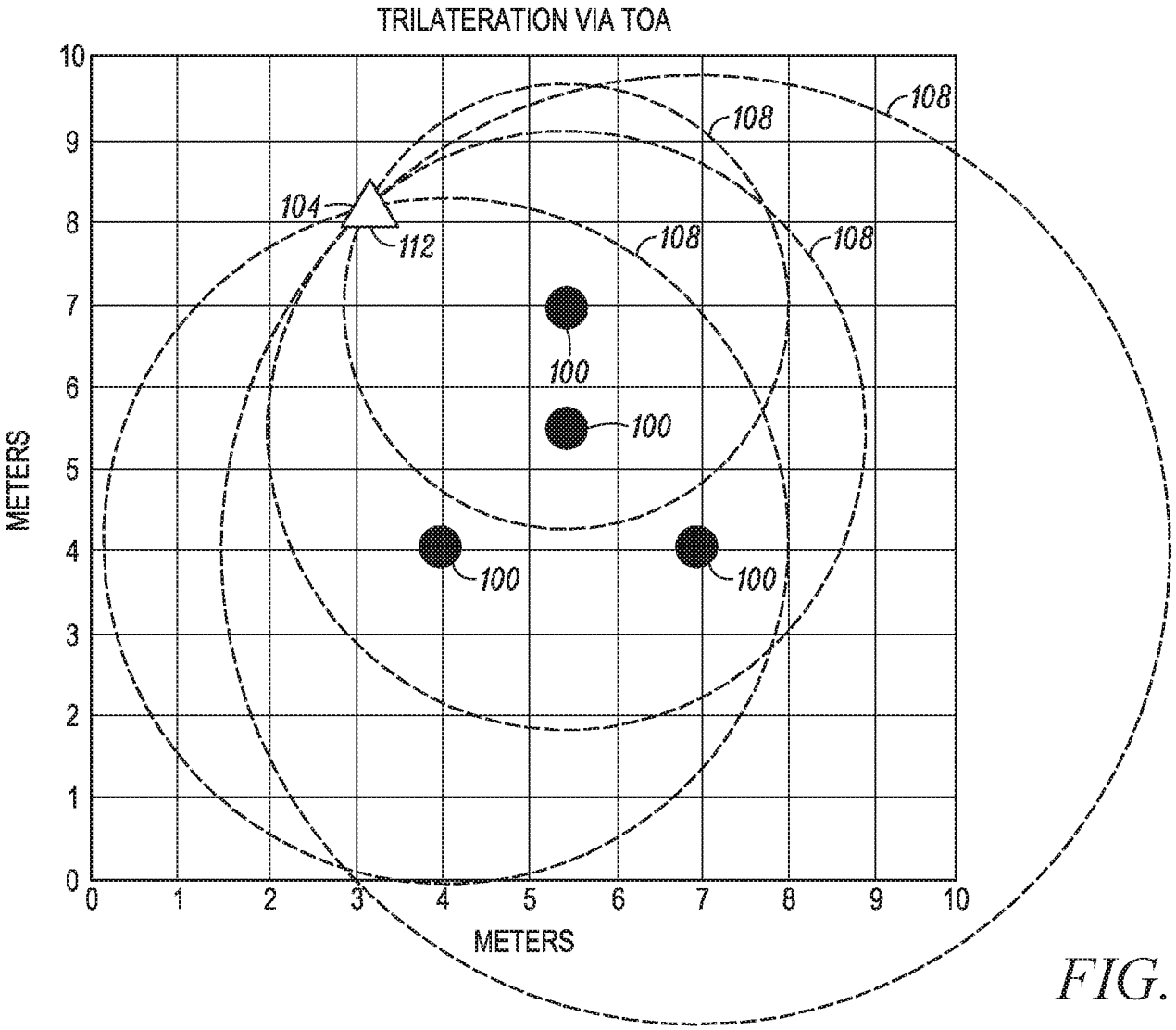
FIG. 7 is a graphical depiction of a Trilateration technique for determining a location of an object using time of arrival (TOA) estimates.

FIG. 7 illustrates this process with four circles 100. Each representing an acoustic sensor that receives a signal broadcast by from a triangle 104 at a known time. The triangle 104 can represent the diver and the acoustic signals from the diver are with respect to the present invention, in fact echoes of signals initially transmitted from the AUV. Each dashed ring 108 represents a potential origin of the broadcast signal (from the triangle 104) relative to each acoustic sensor. Locations where the dashed rings intersect represent potential locations for the broadcast source. In this example, the true location of the triangle is selected since all the circles intersect at a location 112.

A two-sensor system produces two possible locations for the diver. This occurs since the two circles generated from the TOA will have two intersections, which both represent possible origins of the sound source (or in the case of this invention, the echo from an object the location of which is to be determined). With an increase in the number of sensors, a system can produce a unique solution for a target in 3-space.

Because the diver's transceiver reports its depth to the AUV, the trilateration algorithm of this invention can operate with 2-dimensional circles, as opposed to 3-dimensional spheres that would be required if the depth information was not available (as seen in FIG. 7). With the diver's depth known, the AUV can convert the translated 3-space solution into 2-space by first calculating the angle of to the diver $$\left(\theta = \tan^{-1}\left(\frac{(\mathrm{Depth}_{AUV} - \mathrm{Depth}_{Diver})}{\sqrt{\mathrm{Round_Trip_Distance}^2 - (\mathrm{Depth}_{AUV} - \mathrm{Depth}_{Diver})^2}}\right)\right.$$

and then multiplying the TDOA values by cos(θ). This will allow the AUV to locate the diver in a 2-dimensional plane. This closed loop process (i.e., knowing the time of transmission) to acquire the AUV's distance to the diver drastically simplifies the calculations. The open loop solution requires multilateration which uses hyperboloids which extend to infinity with the true location of the sound source at the intersection of the hyperboloids. This method requires a significant amount of processing power to determine the origin of the sound source.

In another embodiment, the diver may simply ping the AUV in an open-loop process (i.e., the time of transmission is unknown). Without knowing the time of origin of the ping, the AUV must use hyperbolic positioning (a time difference of arrival (TDOA) method that examines the time difference between the arrival of signals at different sensors on the AUV to calculate the origin of a sound source) to calculate the diver's position. This method is both processing intensive and is susceptible to signal noise that renders the location system less reliable.

Those skilled in the art are aware that other algorithms can be used to solve for distance, angle, declination, and azimuth to a target. The inventor has chosen the trilateration technique for one embodiment with four sensors, three in an equiangular triangle pattern and a fourth in the center of the triangle as shown in FIG. 6.

Figure 5:
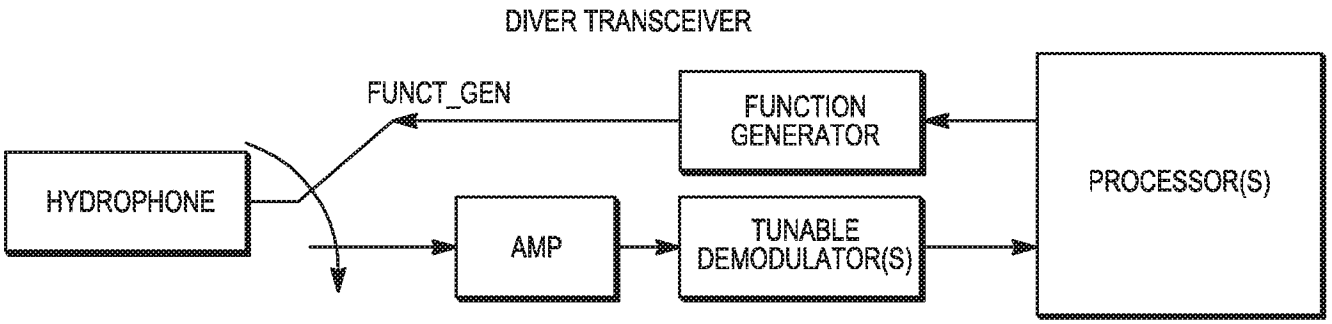
FIG. 5 is a block diagram of an acoustic transceiver located on the diver.

A block diagram of the acoustic transceiver disposed on the diver and the AUV are depicted in respective FIGS. 4 and 5. Both the AUV and the diver's transceiver can broadcast in the ultrasonic range (20 kHz to 500 kHz for example). The frequency of the ultrasonic acoustic burst can be altered in the function generator block of FIGS. 4 (the AUV transceiver) and 5 (the diver transceiver) in the event two or more AUVs are operating near each other such that the AUV signals cannot be distinguished.

Typically, these acoustic signals are encoded to represent a message. For example, the diver's transmitter could report its depth to the AUV through standard communication protocols such as On-Off Keying (OOK), or Frequency Shift Keying (FSK). A unique identification signature can be created using these standard protocols. In one embodiment, the AUV and diver transceiver could use an eight-bit identification signature that is transmitted prior to transmitting any information to ensure the communication link is secure.

Another approach uses a variation on OOK where information is encoded in the time delay between pulses transmitted from the diver. The processor in the AUV decodes the time delay using an indexed lookup table. Varying the time delay between pulses represents different information or different numerical values for the information. For example, the diver's depth could be determined to be 60 ft if the time between pulses two consecutive pulses $t_d$ is 60 ms, or 30 ft if $t_d$ is 30 ms.

The amplifiers in FIGS. 4 and 5 each comprise at least one (but not limited to one) operational amplifier (such as the LMV797 in one embodiment) that can provide sufficient gain for the next stage, where the acoustic signal is analyzed.

Figure 8:
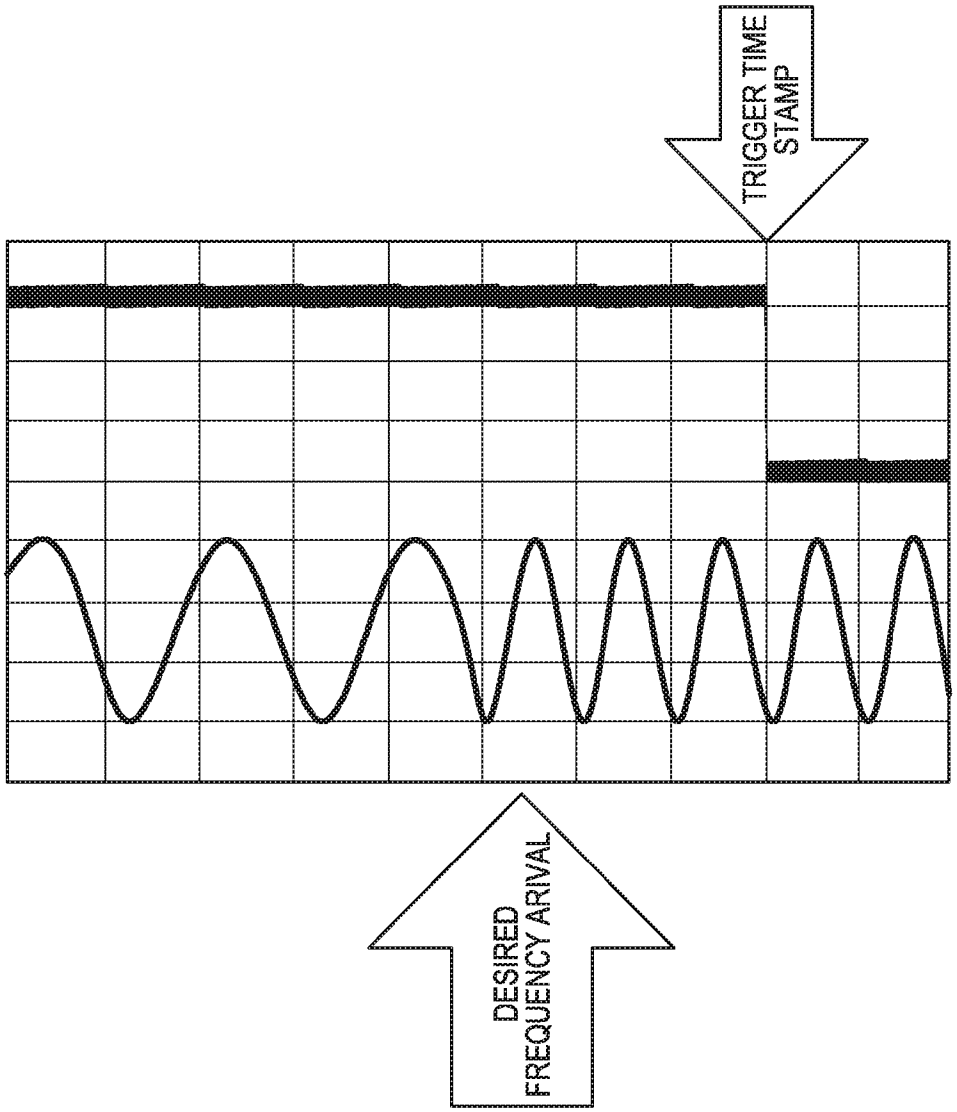
FIG. 8 is a graphical representation of the frequency selection process executed in the tunable demodulator blocks of FIGS. 5 and 6.

The tunable demodulator block of FIGS. 4 and 5 detects whether the incoming signal matches the frequency of interest (the broadcast frequency of the diver's transceiver when the AUV is receiving and the broadcast frequency of the AUV's transceiver when the diver is receiving). If the signal frequency is in fact the frequency of interest, this block will output a logical '0' (see FIG. 8) to the main processor. This event of a sign change tells the processor that an acoustic signal in the desired frequency band was detected. The processor will then internally mark the events.

Th demodulator may comprise either a coherent demodulator such as a PLL (phase locked loop) or a non-coherent demodulator such as an envelope detector.

In one embodiment, the tunable demodulator may be an LM567 tone decoder which performs the frequency detection.

In another embodiment, the demodulator block is replaced with a filter block tied to an analog-to-digital converter that feeds the raw data directly into the processor. In this case, the tunable frequency detection is done inside the processor using DSP algorithms. This data once decoded tells the AUV the diver's depth as well as other key information such as heart rate, temperature, etc.

The function generator comprises a VCO and amplifier that allows the SONAR to broadcast at any frequency within a wide range of frequencies (1 Hz-500 kHz, for example), along with different wave shapes (i.e. sinusoid, square, saw tooth, etc.) for the broadcast signal.

The diver's sensor payload is equipped with a similar function generator.

Figure 9:
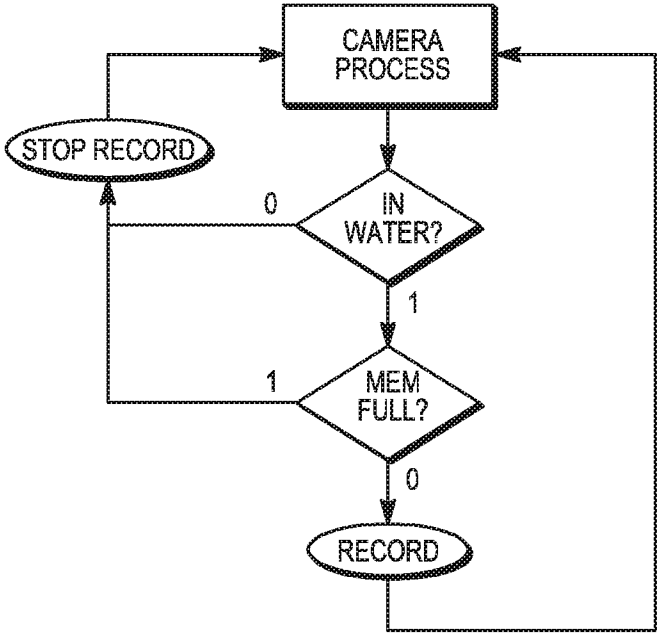
FIG. 9 is a flowchart of the operation of camera(s) onboard the AUV of the present invention.

FIG. 9 depicts a flowchart for a camera paced loop. A paced loop is a deterministic software process whereby all implemented functions are serviced in real time. The AUV is equipped with a comprehensive camera system including but not limited to a single wide angle camera. In on embodiment the AUV may have several cameras that are located on various surfaces of the AUV to capture and process still and video images of the dive from many different angles (i.e. a spherical view). Wide angle lenses for cameras with viewing windows of 180-degrees (or greater) provide hemispheric images. Two cameras with hemispheric lenses placed back-to-back can create a fully spherical image. Generally, given the location of the cameras on the AUV, a full spherical video image can be experienced.

The FIG. 9 paced loop comprises a decision block for determining whether the camera (that is, the AUV) is in the water (an affirmative or "1" response) or out of the water (a negative or "0" response). Those skilled in the art are aware of various types of sensors for use in making this decision. Also, the user can manually activate a component to indicate that the camera is or immediately will be in the water.

In a preferred embodiment, the AUV sensor pack 24 of FIG. 1A (as well as the dive's sensor pack 64 of FIG. 1B) is equipped with a pair of electrodes which are shorted by water between them and thereby detect when the AUV is in the water.

If the camera is out of the water the recording is stopped. But if the camera is in the water and the memory is not full then the camera records the presented images.

The video images are digitized and stored in memory for viewing and/or post-processing. The images can also be used with computer vision algorithms that allow object tracking and object detection. For example, a simple implementation uses color and shape detection to identify a diver's hand. The detection of hand motions, such as pointing, could be used to control the AUV to move closer to/farther from the diver.

The comprehensive camera system and the video images it captures augments the propulsion system, reducing the need for a highly precise control system and thereby reduces the cost, weight, and power draw of the AUV.

One of the primary functions of the AUV is to capture their diver's underwater experience and allow them to relive his/her dive from the comfort of their home through immersive virtual reality. The onboard camera system creates this experience by providing a spherical viewing coverage around the AUV. In a contrary embodiment, the AUV may contain only a single camera which must be always centered on the diver. This demands that the camera can move in six degrees of freedom (the number of movements which can occur in 3-space) to follow the diver. In contrast, by using a comprehensive camera system on the AUV, the camera(s) can record the diver in any location independent of orientation relative to the AUV. Therefore, the AUV needs only to move the cameras in 3 degrees of freedom to accomplish the same task By using a comprehensive camera system, including an embodiment with only a hemispheric lensed camera, the AUV needs fewer thrusters to accurately track the diver, (resulting in lower power consumption, lower weight, and lower costs) to accomplish its tracking goals.

Figure 16:
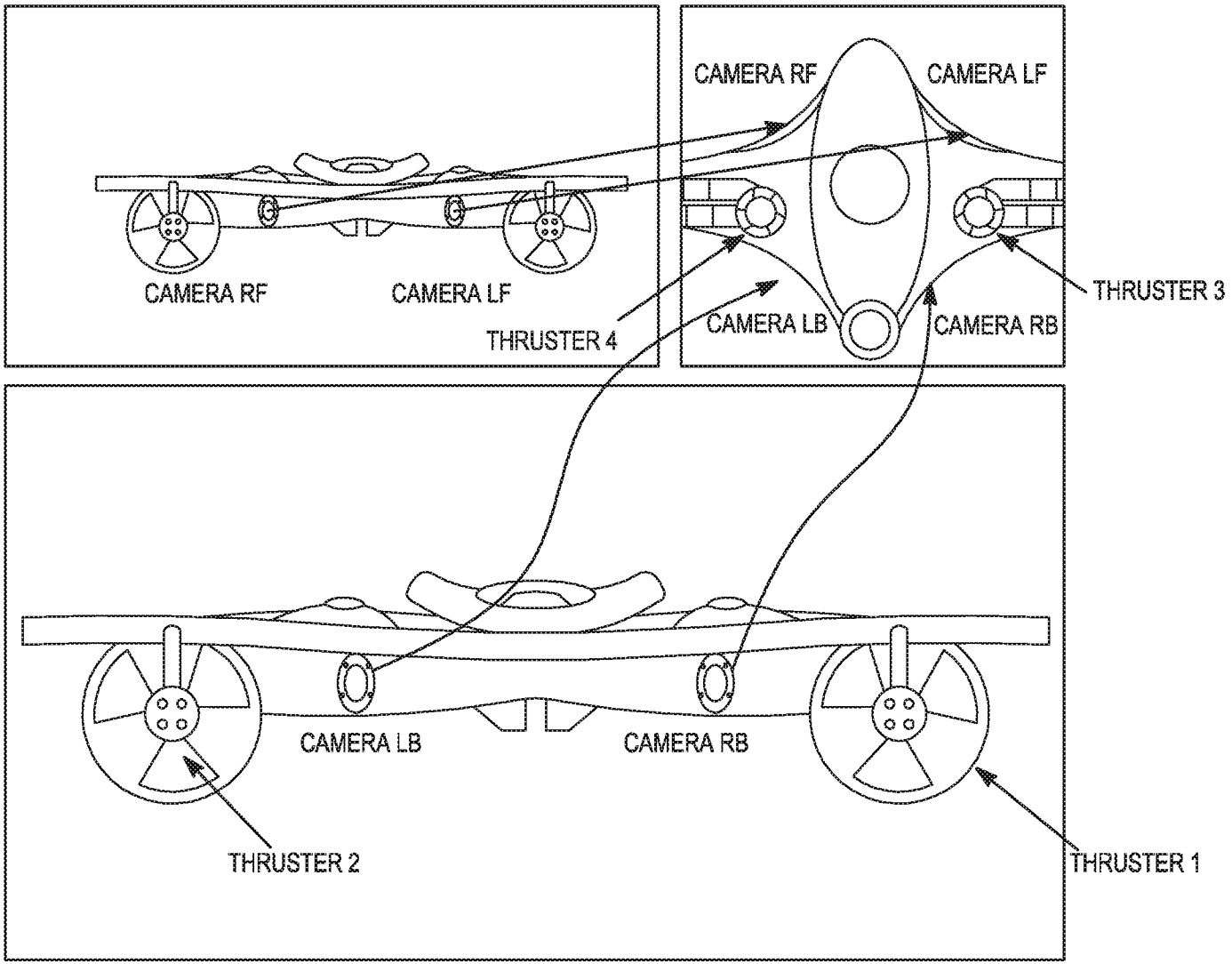
FIG. 16 is a pictorial description of an embodiment of the AUV with a network of cameras along its surface.

An embodiment of the camera network as located on the AUV can be seen in FIG. 16. In this embodiment, there are four cameras (referred to by RF, RB, LF, and LB) on the AUV with wide-angle lens on each camera. One or more cameras may also be located on a bottom surface of the AUV. This camera(s) can be used to capture images of the diver as she/he is located beneath the AUV. deBy using common image stitching algorithms known to those skilled in the art, the diver can relive his dive in seamless spherical video from the perspective of the AUV. This is accomplished by scanning across the stitched video using a smart phone, tablet, or other electronic device. Virtual imaging and/or artificial intelligence techniques can be used during the image playback time, during which the diver can relive his dive experience.

Figures 13A, 13B, 13C:
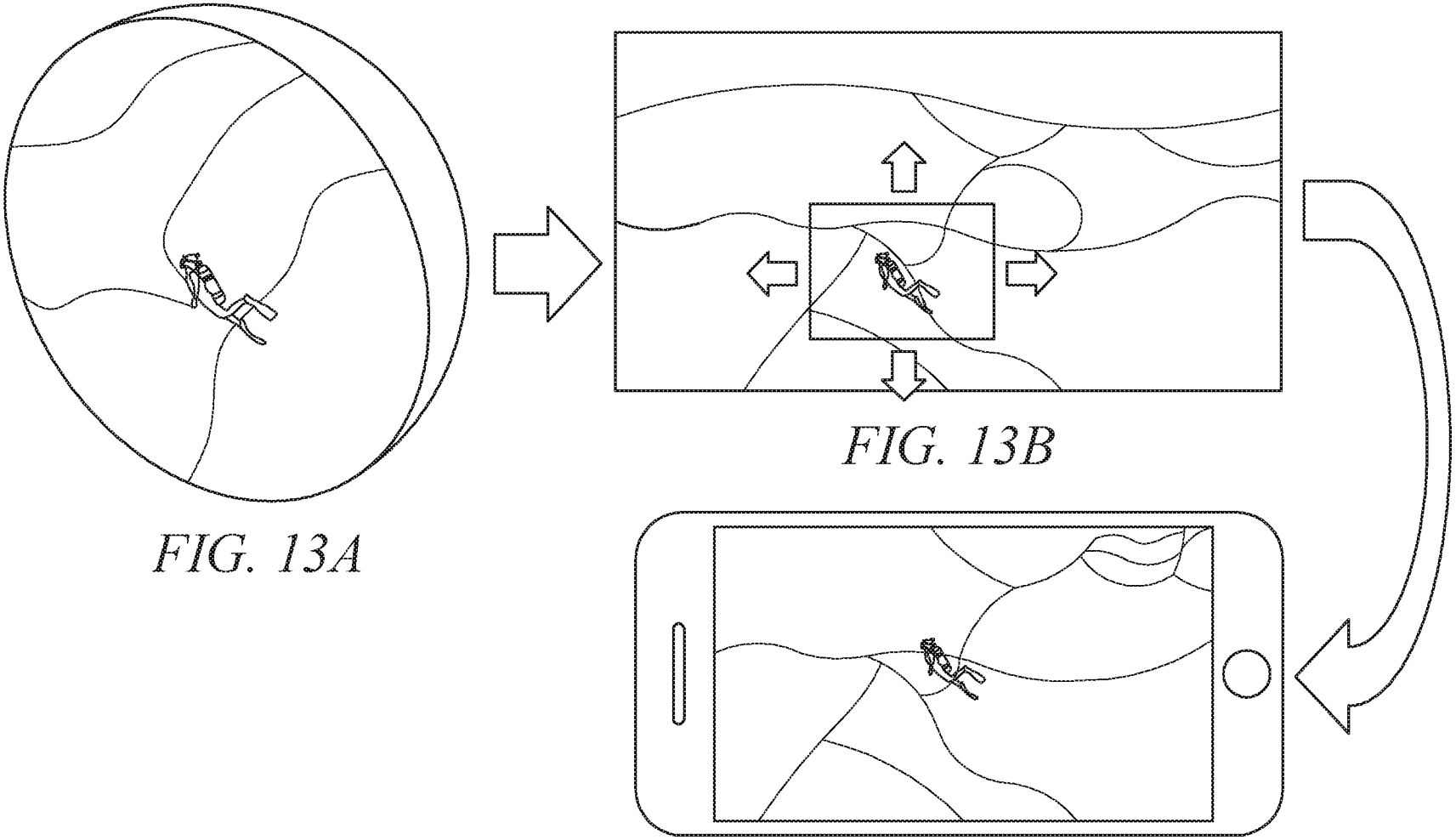
FIGS. 13A, 13B, and 13C are images processed to create a seamless spherical viewing experience for the user.

FIGS. 13A, 13B and 13C illustrate the windowing process that allows the diver to zoom in on a specific image area in post-processing. FIG. 13A represents the spherical image formed by stitching the discrete images from each of the cameras 200 on-board the AUV. FIG. 13B represents the stretching process to fit the spherical image onto a rectangular viewing screen. A square in FIG. 13B identifies a zoomed-in image window. This window can be manipulated by the user to view specific regions of the image. FIG. 13C illustrates the selected window from the perspective of the AUV. The greater number of cameras in the network, the lower the required viewing angle of each camera which will result in a higher quality image.

Obstacle Detection for Collision Avoidance

Figure 12:
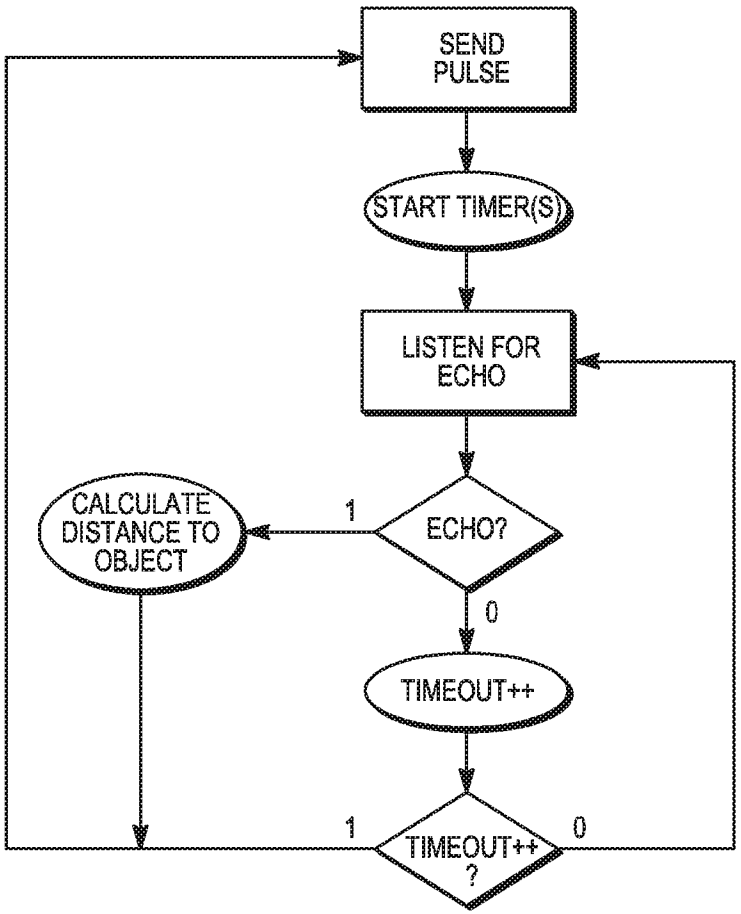
FIG. 12 is a flowchart description of the process to determine if there is an object near the AUV.

At periodic intervals, the AUV transmits an ultrasonic acoustic burst that differs in frequency from the burst used for diver detection. At the time the signal is transmitted the AUV starts an echo timer (see the FIG. 12 flowchart) to count the time delay between the transmission and subsequent reflections.

Once the AUV has received a response it can calculate the distance to a proximate object that reflected the burst. Multiple reflections indicate multiple nearby objects. Both tracking and obstacle detection can be accomplished with the same circuitry by multiplexing the acoustic transducers. This is possible since both the location detection SONAR and obstacle detection SONAR require similar circuitry to function. Generally, the same components that are used to acoustically track and communicate with the diver can be used for obstacle detection. Similar components are used in the diver's transceiver.

Communications with the Diver

The AUV can communicate with the diver using multiple techniques.

1. Acoustically

This system supports several communication protocols (i.e. OOK, FSK, etc.) for both transmitting and receiving information. The information communicated can be analog sensor data, as well as analog or digital human inputs.

2. Optically

Signals can be sent using lights (such as steady or blinking LEDs). Information can also be communicated using image screens (LCD, LED, etc.) as well as optical projection. The AUV may use optical indicators to relay information to the diver such as battery life, oxygen levels, bottom time, and other items of relevance.

Sensor Payload as Carried by the Diver

Sensors on or proximate the diver can monitor the diver's health and vital signs (e.g., heart rate) and communicate this information to the AUV. The tank air pressure can be monitored by a sensor connected to the diver's air hose. Sensors can also include a depth sensor, temperature sensor and accelerometer, etc.

System Overview During a Dive

Figure 14:
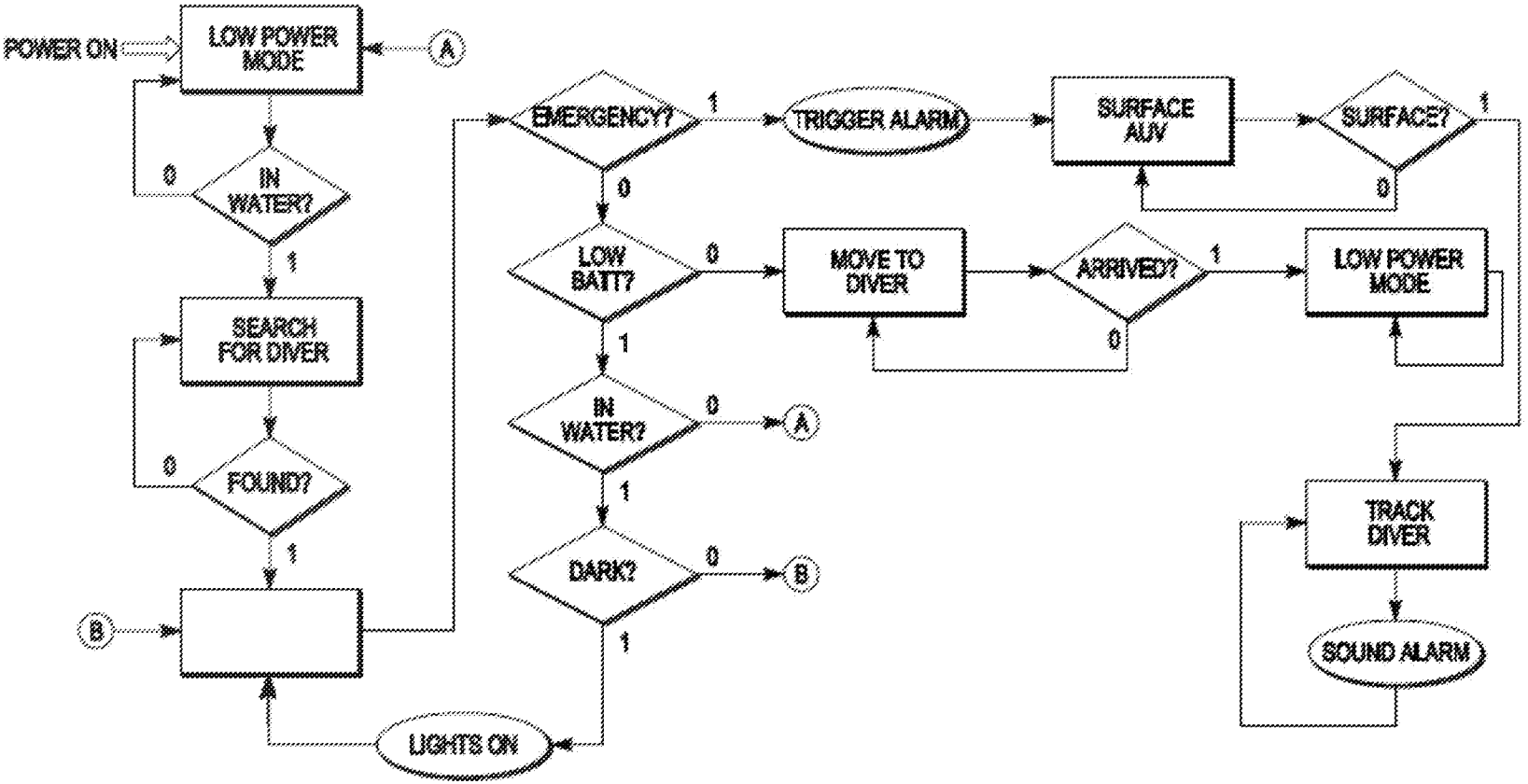
FIG. 14 is a series of interconnected flowcharts that illustrate various operational modes and conditions of the AUV.

The AUV can be used during all phases of a typical SCUBA diving trip. The operational modes of a paced loop which can be seen in FIG. 14.

Launch Phase

The launch phase of a dive comprises several features that begin with detecting that the AUV has contacted the water. Upon submersion, the AUV begins video recording the dive and starts listening for a unique and detectable acoustic or optical signal emitted by a compatible device on the diver. Detection of this signal acquires the diver. Once the AUV acquires the diver, (which typically occurs in less than 30 seconds) the AUV begins to track the diver's location.

Dive Phase

Once the diver has been acquired, the AUV automatically begins to follow the diver at a preset distance from the diver. As part of its autonomous function, the AUV always avoids collisions with inanimate objects, divers, sea creatures and anything else it may encounter in its path, using the obstacle detection techniques described elsewhere herein.

While underwater, the AUV tracks its own battery life. If the AUV battery level drops below a certain threshold, the AUV will stop aside the diver so that the diver can power-down the AUV and take it to the surface.

The features used during this phase of the dive include the camera system, a built-in flashlight, and a safety monitoring system. Each camera is optimized with lenses and filters, for underwater operation.

The on-board flashlight has a plethora of operational modes, including the light beam width, such as spotlight, sector, and omnidirectional. Light intensity can also be controlled and the flashlight can be controlled to shine as directed by the diver or automatically as it tracks the diver. In one embodiment, the on-board flashlight can be programmed with the diver's planned dive path to light the path as the diver traverses it. As the AUV descends into the water it monitors ambient light levels to determine when the flashlight should be activated.

Other functions include safety features for both the diver and his equipment. The diver's vital signs are monitored including heart rate, respiratory rate, and other important biological parameters. The AUV monitors other items important to diver safety including dive depth, dive time, oxygen levels, and other parameters associated with the dive equipment. In the event of an out-of-bounds condition, such as the diver's heart suddenly dropping below a predetermined threshold or oxygen levels falling below a threshold value, the AUV alerts the diver by, for example, sending an appropriate acoustic signal to the diver and/or to personnel in a nearby boat, the dive boat for example.

At any time during the dive the diver may initiate an emergency sequence (described later) whereby the AUV attempts to alert others (both underwater as well as on surface) that the diver is in peril.

Additionally, at the end of the dive phase, the AUV holds its position at a preprogrammed safety stop(s) for a fixed period based on dive table look ups performed by the AUV. The parameters used to calculate the diver's safety stop are dive depth and duration. For example, if a diver descends to a depth of 100 ft and the overall dive is 30 minutes he may be required to perform a safety stop at 50 ft for 2 minutes as well as a second safety stop at 20 feet for 5 minutes. The safety stops are necessary to allow the diver's body to release excess nitrogen in the blood before ascending.

Figure 15:
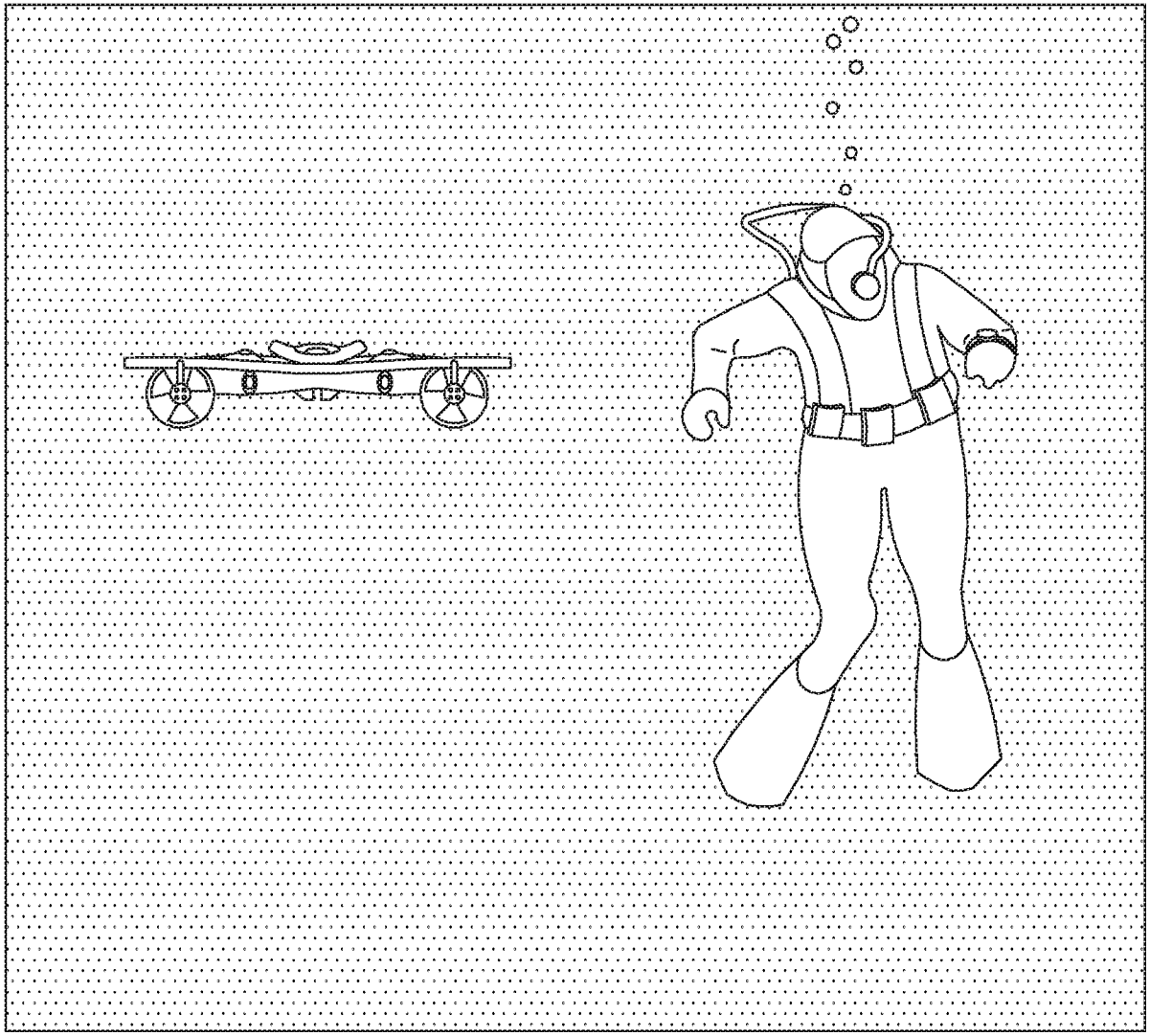
FIG. 15 is a pictorial image of the open-water column where diver safety stops are performed.

As shown in FIG. 15, safety stops are often done in a water column with no visual reference for the diver to determine if he is rising or falling. It is critical that the diver maintain the correct depth for the duration of the safety stop; descending will negate the stop and ascending could result in decompression sickness. To aide in this process, the AUV maintains a constant depth using its onboard sensors and control system to provide a visual reference at the correct depth for the diver.

Emergency Condition

If the diver encounters an emergency, he can initiate the AUV's emergency sequence during emergency situations, the AUV generates several audible and visual signals (i.e. sirens and flashing lights), to alert both people on the surface as well as other divers below the surface. Additionally, in one embodiment the AUV is equipped with a radio transmitter that can relay its current GPS position on the surface to local authorities and others.

Alternate Emergency Condition ("Call for Family")

If the diver encounters an emergency, he may initiate the AUV's emergency protocols. In this state the AUV broadcasts a distress call (both audible and ultrasonic) to call other divers with AUVs to come to the aid of the distressed diver. This mode is referred to as a "call for family" mode. When an AUV hears, a distress call it will alert its diver and can lead him/her to the distress source.

Lost Condition

Should the AUV lose contact with the SCUBA diver while underwater, it will hold its position for a fixed duration of time and attempt to audibly and visually (blink) communicate to reacquire the diver. After a predetermined amount of time has elapsed, the AUV ascends and emits audible and visual signals to contact the diver.

Recovery Phase

Upon removal from the water, the AUV detects that it is no longer submerged and enters a low power mode. Once out of the water, the diver can extract video footage from the AUV for review and storage on other devices. In one embodiment, the video could be streamed over a Wi-Fi connection to the diver's smartphone or tablet for immediate viewing.

While the invention has been described regarding preferred embodiments, it will be understood by those skilled in the art that various changes may be made and equivalent elements may be substituted for elements thereof without departing from the scope of the present invention. The scope of the present invention further includes any combination of the elements from the various embodiments set forth. In addition, modifications may be made to adapt a particular situation to the teachings of the present invention without departing from its essential scope. Therefore, it is intended that the invention not be limited to the particular embodiment disclosed as the best mode contemplated for carrying out this invention, but that the invention will include all embodiments falling within the scope of the appended claims.

What is claimed is:

1. A system for use by a diver during an underwater dive, the system comprising:

an autonomous underwater vehicle (AUV) comprising:
- an AUV acoustic transceiver;
- a plurality of AUV sensors;
- a propulsion unit;
- a processor for determining dive information and diver information responsive to data from one or both of the AUV acoustic transceiver and the plurality of AUV sensors;
- one or more cameras positioned on the AUV to record multiple images of a region surrounding the AUV during a dive, such that when the multiple images are stitched together a spherical image is produced; and diver equipment carried by the diver, the diver equipment comprising:
- a plurality of diver sensors; and
- a diver acoustic transceiver for receiving sensed information from the plurality of diver sensors and communicating the sensed information to the AUV acoustic transceiver, the diver acoustic transceiver for receiving information from the AUV acoustic transceiver.

2. The system of claim 1 further comprising a component for detecting that the AUV has entered water, wherein the component comprises a pair of electrodes, wherein water between the pair of electrodes shorts the electrodes thereby producing a signal indicating that the vehicle has entered the water, wherein the AUV acoustic transceiver, the plurality of AUV sensors, the propulsion unit, the processor, and the one or more cameras are activated upon the component detecting that the AUV has entered the water.

3. The system of claim 1 wherein the dive information or the diver information comprise at least diver's location and diver's bottom time.

4. The system of claim 1 wherein data provided by the plurality of AUV sensors is used to determine one or more of a distance to the diver, azimuth angle of the diver relative to a reference horizontal axis, and declination of the diver relative to a reference vertical axis.

5. The system of claim 1 wherein the plurality of AUV sensors are separated by a known distance, and wherein arrival time of a signal at each sensor of the plurality of AUV sensors is determined and used to determine a location of the diver, the signal sent from the diver acoustic transceiver.

6. The system of claim 1 wherein a diver location in three-dimensional space is determined based on an azimuth angle to the diver relative to a reference horizontal axis including the AUV, and further based on diver depth information and AUV depth information.

7. The system of claim 1 wherein the one or more cameras supply images of diver gestures to the processor for interpreting the gestures and controlling operation of the AUV responsive thereto.

8. The system of claim 1 wherein the AUV and the diver equipment each comprise an optical transmitter and an optical receiver for communicating information between the AUV and the diver.

9. The system of claim 1 wherein the AUV determines diver ascension safety stops and a duration of each stop, and wherein during diver ascension the AUV holds a depth at each safety stop for a determined duration, such that the diver can follow the AUV to each safety stop and hold at each safety stop for the determined duration.

10. The system of claim 1 wherein the AUV tracks the diver and maintains a predetermined distance from the diver.

11. The system of claim 1 wherein if the AUV loses contact with the diver, the AUV maintains a current position for a predetermined duration during which the AUV transmits a signal for receiving by the diver, and after the predetermined duration has elapsed, the AUV ascends and emits audible and visual signals.

12. The system of claim 1 wherein the spherical image is centered at the AUV.

13. A system for use by a diver, during an underwater dive, the system comprising:

a tracking component for tracking a location of a diver;

a propulsion component responsive to the tracking component for maintaining an AUV at a distance from the diver;

one or more cameras on the AUV for capturing video images of regions surrounding the AUV; and an image processing component for stitching the video images to create a spherical image.

14. The system of claim 13 the one or more cameras comprising two cameras each having a hemispherical field of view.

15. The system of claim 13 the tracking component comprising an acoustic transceiver for transmitting acoustic signals to the diver and for receiving acoustic reflections from the diver.

16. The system of claim 13 wherein the spherical image is centered at the AUV.

17. An autonomous underwater vehicle (AUV) comprising:

an acoustic sensor;

a plurality of image sensors;

a propulsion unit;

a processor for controlling the propulsion unit to track a diver; and wherein images from the plurality of image sensors are stitched together to form a spherical image for viewing using a virtual reality device, the spherical image centered at the AUV.

18. The autonomous underwater vehicle of claim 17 wherein tracking the diver comprises maintaining the diver within a field of view of one or more of the plurality of image sensors.

19. The autonomous underwater vehicle of claim 17 wherein one or more of the plurality of image sensors comprises a camera having a 360-degrees field of view.

20. The autonomous underwater vehicle of claim 17 for tracking a diver and maintaining a predetermined distance from the diver, and wherein if the AUV loses contact with the diver, the AUV maintains a current position for a predetermined duration during which the AUV transmits a signal for receiving by the diver, and after the predetermined duration has elapsed, the AUV ascends and emits audible and visual warning signals.

* * * * *